United States Patent [19]

Judge

[11] Patent Number: 4,629,108

[45] Date of Patent: Dec. 16, 1986

[54] MECHANICAL STAPLER FRAME AND COVER ASSEMBLY

[75] Inventor: Alfred H. Judge, Raleigh, N.C.

[73] Assignee: Black & Decker, Inc., Newark, Del.

[21] Appl. No.: 704,278

[22] Filed: Feb. 22, 1985

[51] Int. Cl.[4] ..... B25C 5/06; B25C 5/11

[52] U.S. Cl. ..... 227/132; 227/156; 227/120

[58] Field of Search ..... 227/120, 432, 156

[56] References Cited

U.S. PATENT DOCUMENTS

| | | | |
|---|---|---|---|
| 2,769,174 | 11/1956 | Libert | 227/132 |
| 3,786,978 | 1/1974 | Manganaro | 227/8 |
| 4,119,258 | 10/1978 | Ewig, Jr. | 227/132 |
| 4,184,620 | 1/1980 | Ewig | 227/8 |
| 4,452,388 | 6/1984 | Fealey | 227/132 |

*Primary Examiner*—Paul A. Bell

*Attorney, Agent, or Firm*—Finnegan, Henderson, Farabow, Garrett & Dunner

[57] ABSTRACT

The invention is directed to a mechanical stapler frame and cover assembly having first and second frames and first and second cover plates. The first frame, which is formed of metal, includes a first component support section and opposed end sections projecting substantially orthogonally from the first support section to provide a first pair of mating edges. The second frame, which is formed of metal, includes a second component support section and opposed end sections projecting substantially orthogonally, from the second support section to provide a second pair of mating edges. The latter mating edges are spaced apart at distances sufficient to engage the first mating edges when the first and second frames are placed in abutting relation. The first and second support sections include a plurality of openings. A predetermined number of the openings contain a tab extending from the opening. The first and second cover plates, which are formed of plastic, are configured to envelop the first and second frames. Screws may be used to secure the cover plates together.

10 Claims, 9 Drawing Figures

MECHANICAL STAPLER FRAME AND COVER ASSEMBLY

BACKGROUND OF THE INVENTION

I. Field of the Invention

The present invention relates to a frame and cover assembly for a mechanical stapler.

II. Background of the Invention

There are a number of support frame and cover assemblies used with conventional staplers. For example, U.S. Pat. No. 4,119,258 to Ewig, Jr. discloses a frame consisting of two spaced parallel side walls formed of a high density polymer. The interior of the side walls have webs which cooperate to define structural support features for the internal components of the stapler. The support features include an internally directed flange which cooperates with a similar flange on the other half of the housing and the side walls to define a cavity, as well as a boxlike enclosure formed by two other flanges. The stapler contains a hammer that is slidable within the box-like enclosure and a spring, a portion of which fits within the cavity. Ewig, Jr. discloses that the high density polymer stapler frame is particularly advantageous because of the difficulty in producing a lowcost, lightweight metal stapler.

Frame and cover assemblies also have been made using a combination of metal and plastic components. U.S. Pat. No. 3,786,978 to Manganaro discloses an electromagnetic stapler having a pair of metal frame members comprising a plurality of wall surfaces for enveloping the stapler components. A pair of the wall surfaces are bent to support a base plate beneath the bumper or plunger element. The frames include apertures for receiving bolts to secure various stapler components to the frames. The stapler also includes a front cover plate secured to the frames. Further, a pair of insulating covers are fixed to each other about the frame members. U.S. Pat. No. 2,769,174 to Libert is similar to Manganaro and includes a metal frame member that provides a housing and a support for other elements of the stapler. This reference includes a front cover plate, which is affixed at the sides of the frame. Neither Libert or Manganaro disclose surfaces, such as the flanges in Ewig, Jr., which are capable of providing structural support to the internal components of the stapler. In addition, both of these references require a separate cover plate on the front portion of the stapler, thus complicating the manufacture and increasing the cost of production of the stapler.

As is apparent from consideration of the noted conventional devices, it has been desirable to provide frame members for mechanical staplers which are formed of metal, since such devices are more durable and less susceptible to fatigue. However, as evidenced by Ewig, Jr. the cost of production of such frames and the overall effect on the weight of the stapler have outweighed the obvious benefits of metal frame members. Hence, the trend is to produce frame members formed of plastic, which are also generally much easier to assemble.

It is, therefore, a principal objective of the present invention to provide an economically manufactured stapler frame and cover assembly that employs a metal frame to give effective structural support to the internal stapler components.

It is an additional objective of the present invention to provide a frame and cover assembly having a reduced number of parts that is correspondingly easy to assemble.

It is another objective of the present invention to provide a simple and economical method of forming a stapler frame and cover assembly.

Additional objectives and advantages of the present invention will be set forth in part in the description that follows and in part will be obvious from the description or may be learned by practice of the invention. The objectives and advantages of the invention may be realized and obtained by the methods and apparatus particulary pointed out in the appended claims.

SUMMARY OF THE INVENTION

The objectives and advantages of the present invention are achieved by means of a frame and cover assembly having a first and second frame, as well as a first and second cover plate. The first frame, which is formed of metal, includes a first component support section and opposed end sections projecting substantially orthogonally from the first support section to provide a first pair of mating edges. The second frame, which is formed of metal, includes a second component support section and opposed end sections projecting substantially orthogonally from the second support section to provide a second pair of mating edges. The latter mating edges are spaced apart at distances sufficient to engage the first mating edges when the first and second frames are placed in abutting relation. The first and second support sections include a plurality of openings. A predetermined number of the openings contain a tab extending from the opening. The first housing, which is formed of plastic, is configured to receive and hold the first frame. A second housing, which is formed of plastic, is configured to receive and hold the second frame. Means are provided for securing the first and second housings together and about the first and second frames to hold the first and second mating edges in abutting relation.

The objectives and advantages of the present invention are further achieved by a method of forming a frame and cover assembly for a mechanical stapler. The steps of this method include stamping first and second metal frames producing a plurality of openings and flanges to support the internal components of the stapler and in which the flanges extend individually from a predetermined number of the openings. The method further comprises forming a plastic clam shell housing for disposition about the first and second flanges. The housing contains first and second cover plates which envelop a substantial portion of the exterior of the frames. The cover plates include stanchions and hollow posts which are aligned with a predetermined number of the first and second openings.

The accompanying drawings, which are incorporated in and constitute a part of this specification, illustrate one embodiment of the invention and, together with the description, serve to explain the principles of the invention.

DESCRIPTION OF THE PREFERRED EMBODIMENT

Reference will now be made in detail to a presently preferred embodiment of the invention, an example of which is illustrated in the accompanying drawings.

Figure 3:
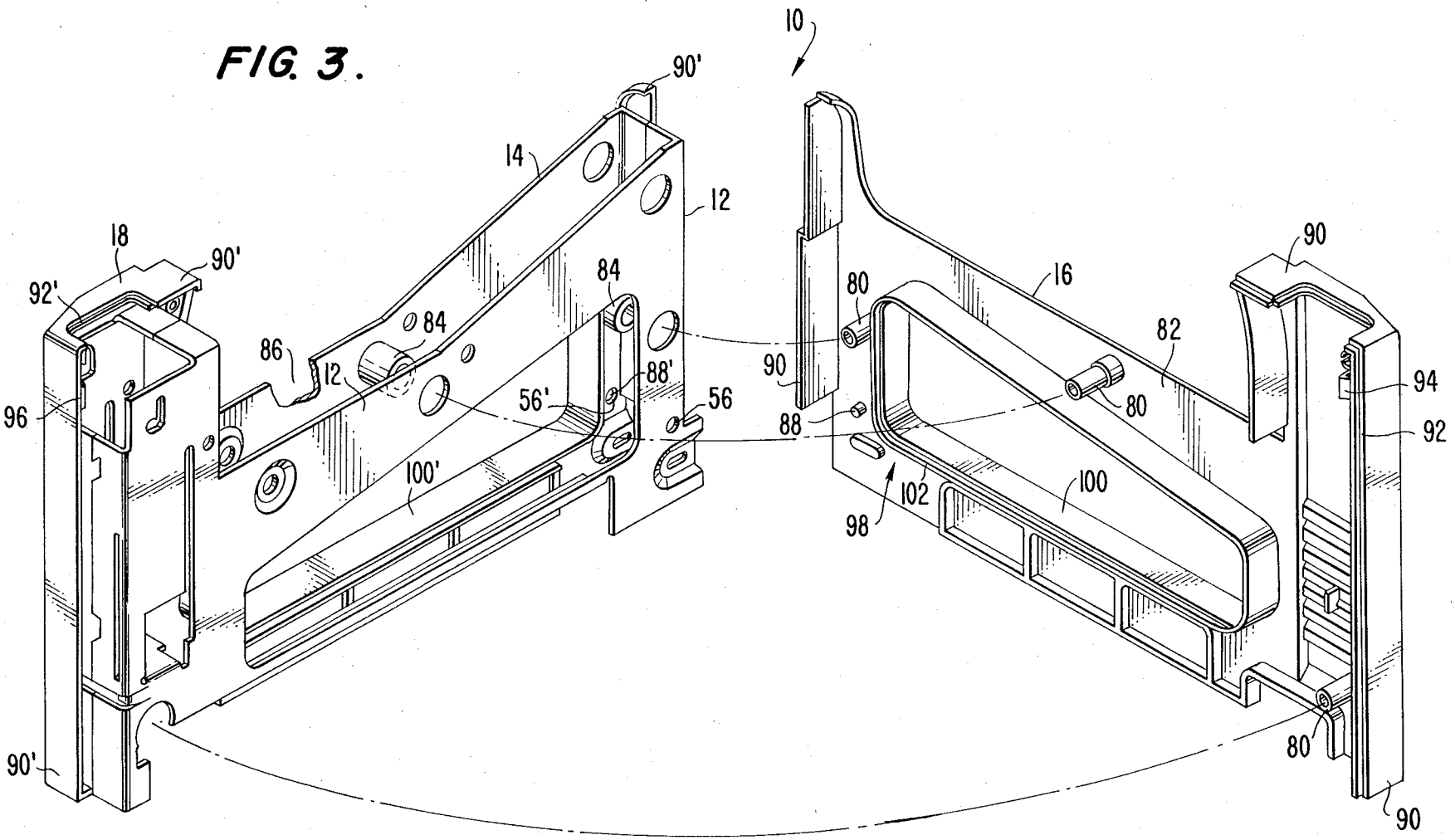
FIG. 3 is a perspective view of the frame and cover assembly of FIGS. 1 and 2 showing one cover plate spaced apart from the remainder of the assembly.

Referring now to FIG. 3, it may be seen that the present invention is a frame assembly, capable of providing structural support for the internal components of the stapler, and a cover assembly, which eliminates possible contact with the internal stapler components and offers an attractive gripping surface for the user. The frame and cover assembly, which is generally designated 10, includes a first frame 12, a second frame 14, a first cover plate 16 and a second cover plate 18.

Figure 5:
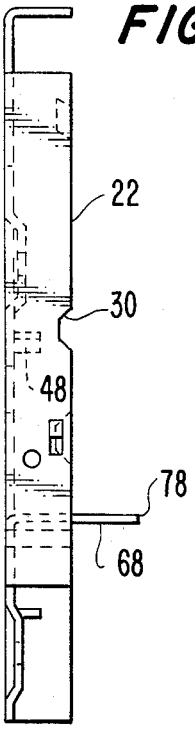
FIG. 5 is an end view of the first frame of FIG. 4 viewed in the direction of arrows YY.
Figure 6:
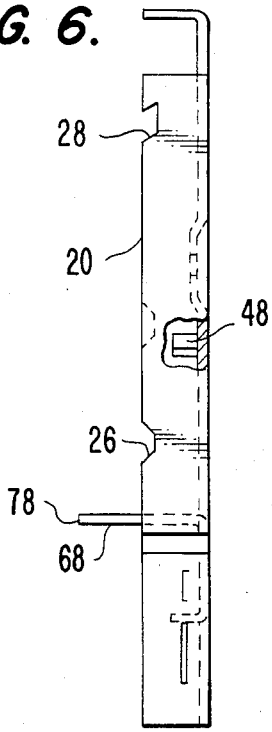
FIG. 6 is an end view of the first frame of FIG. 4 viewed in the direction of Y'Y'.
Figure 8:
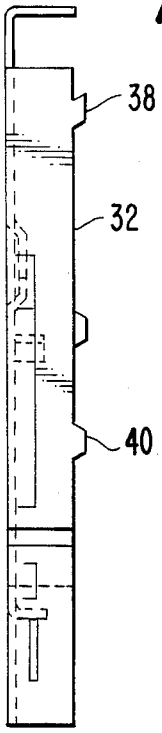
FIG. 8 is an end view of the second frame of FIG. 7 viewed in the direction of arrows ZZ.
Figure 9:
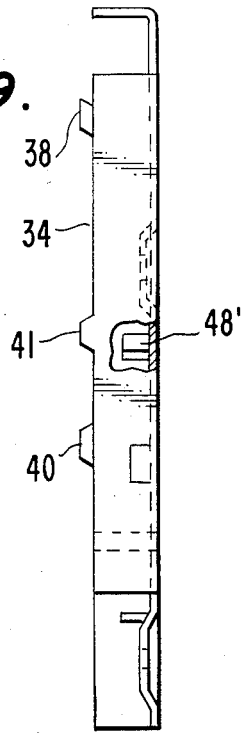
FIG. 9 is an end view of the second frame of FIG. 7 viewed in the direction of arrows Z'Z'.

In accordance with the invention, the first and second frames include a stapler component support section and end sections at opposite ends of each support section. As embodied herein and viewed together in FIGS. 4–6, the first frame 12 includes front end section 20 and rear end section 22 extending from opposite ends of and projecting substantially at right angles to the first component support section 24. Front end section 20 contains a cut-out 26 and a hooked cut-out 28, while rear end section 22 contains a second cut-out 30. Similarly, as viewed in FIGS. 7–9, the frame 14 includes a front end section 32 and a rear end section 34 extending from opposite ends of and projecting substantially at right angles to the second component support section 36. On the upper portion of front end section 32 of second frame 14 is a hooked projection 38 having a shape and location corresponding to hooked cut-out 28. Spaced beneath hooked projection 38 is a projection 40, which corresponds in shape and location to cut-out 26 on first frame 12. Rear end section 34 of second frame 14 contains a second projection 41 complementary to cut out 30. When frames 12, 14 are in abutting relation the projection 40 and second projection 41 are positioned within cut-out 26 and second cut-out 30, respectively, thereby preventing sliding movement between frames 11, 12. Further, hooked projection 38 is positioned within the hooked cutout 28 to limit separation between frames 11, 12.

Figure 1:
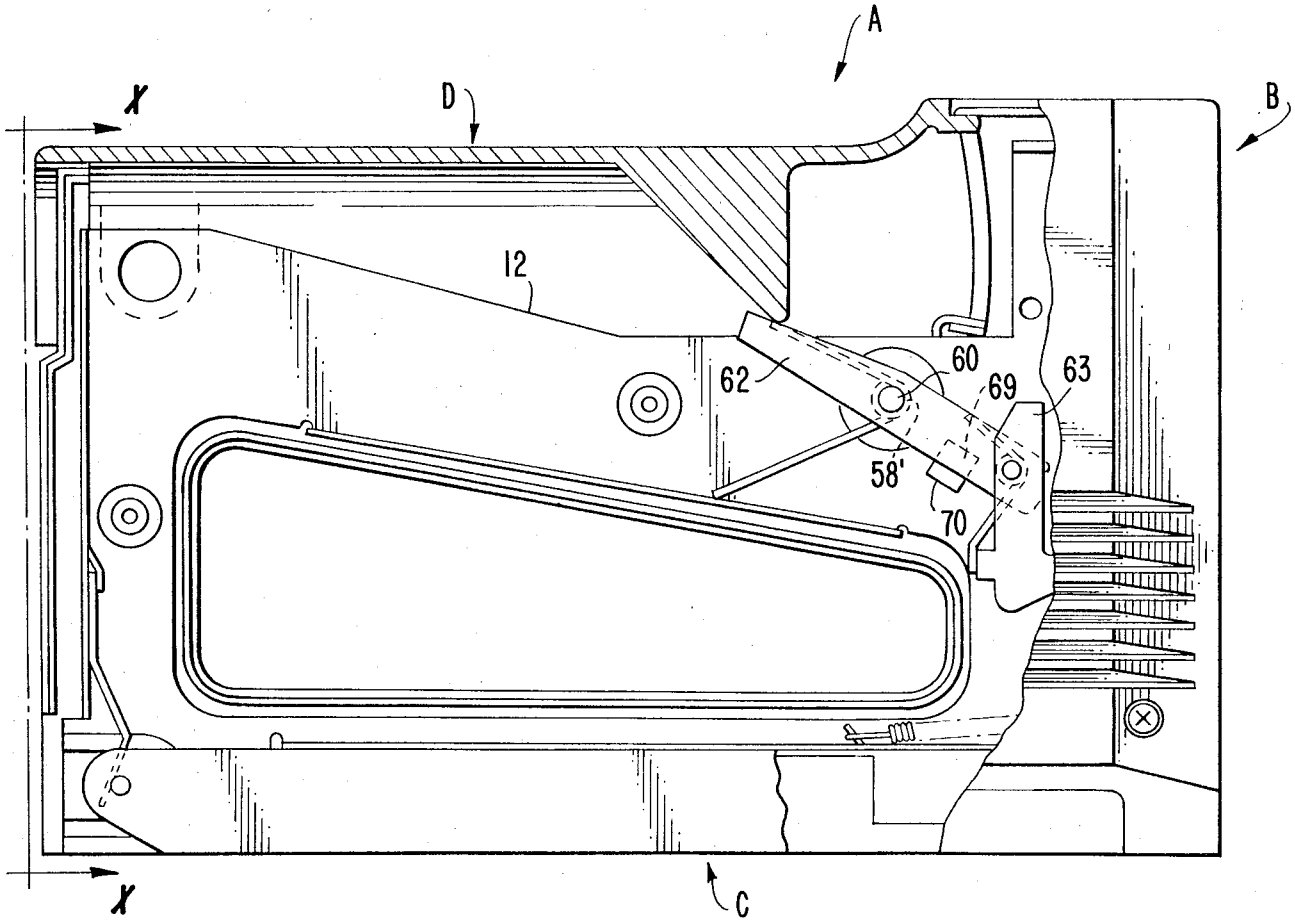
FIG. 1 is a partial cross-sectional side view of a stapler of the present invention.
Figure 4:
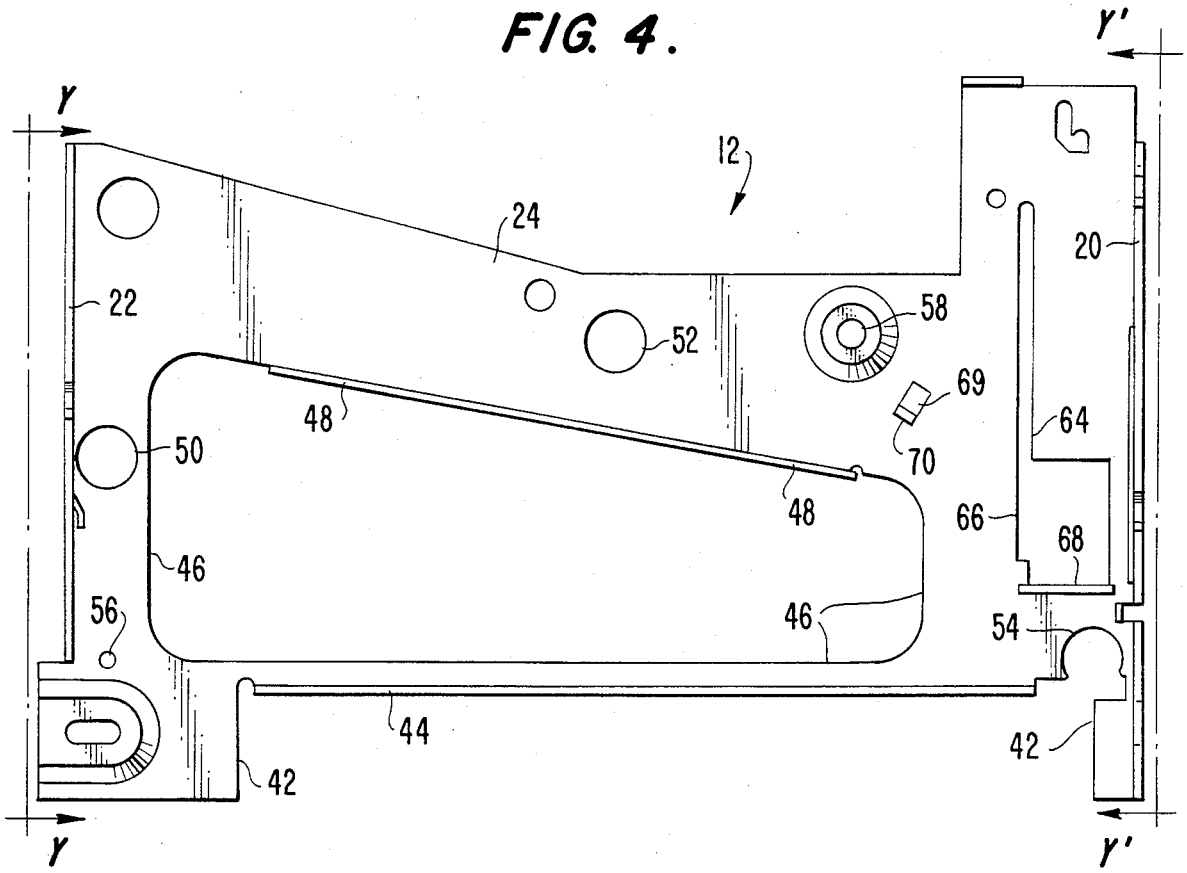
FIG. 4 is a side view of the first frame of the present invention.
Figure 7:
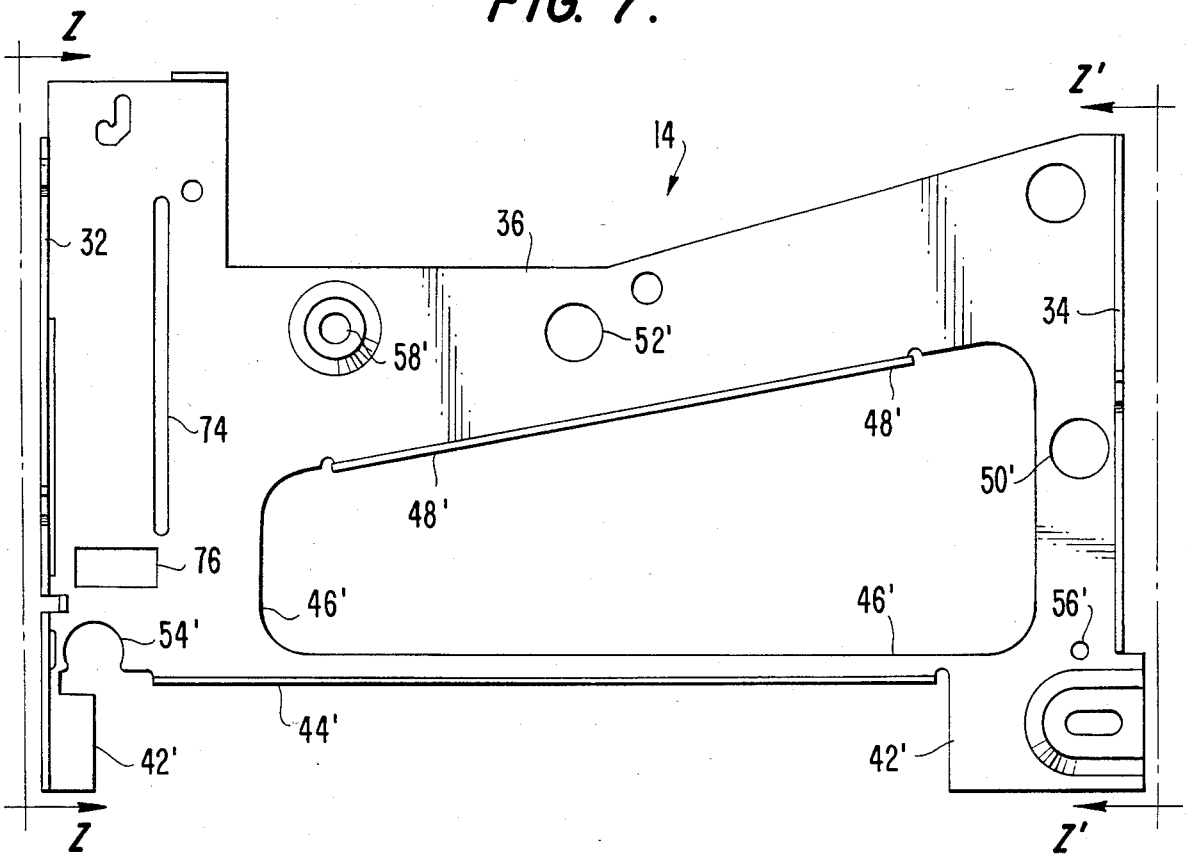
FIG. 7 is a side view of the second frame of the present invention.

As embodied herein and as shown in FIGS. 4 and 7, the first and second component support sections 24, 36 include a plurality of similar openings, some of which contain flanges or tabs extending substantially orthogonally from the openings, for providing structural support to the internal components of the stapler. Reference numerals pertaining to like elements of both support sections 24, 36 will be listed together. In this respect, support sections 24, 36 include a base opening 42, 42' for receiving the stapler's magazine and a flange 44, 44' disposed to provide an adjacent surface to the magazine. The support sections 24, 36 also contain a handle opening 46, 46' having tabs 48, 48' extending a substantial distance between the frames 12, 14. A plurality of sleeve openings are also disposed about the support sections 24, 36. Preferably, a total of three sleeve openings, denoted by reference numerals 50, 52 and 54 (Frame 12) and 50', 52' and 54' (Frame 14), are positioned about the support sections 24, 36. While sleeve openings 50-52' are self-contained openings, the sleeve openings 54, 54' are contiguous with the base opening 42, 42'. Further, support sections 24, 36 include slide openings 56, 56', which are positioned beneath sleeve openings 50, 50'. Additional openings common to both support sections 24, 36 may be stamped onto both frames 12, 14 to provide support for like stapler components. For example, transverse openings 58, 58' on both support section 24, 36 receive opposite ends of a pivoting bar 60 for an actuating lever 62, which operates actuating arm 63, as shown in FIG. 1.

As embodied herein and as shown in FIG. 4, the first component support section 24 contains additional elements distinct from second component support section 36. Specifically, support section 24 includes a first elongated plunger opening 64 and an expanded portion 66 at the base of the first elongated plunger opening 64. The base of the expanded portion 66 of the first elongated opening 64 provides a one-piece flap 68 that extends between frames 12, 14. Further, the support section 24 may include a restrainer opening 69 having a restrainer tab 70, which restricts clockwise rotation of actuating lever 62, as depicted in FIG. 1.

As embodied herein and as shown in FIG. 7, the second component support section 36 is characterized by certain elements distinct from first component support section 24. In particular, support section 36 includes a second elongated plunger opening 74 which is essentially parallel to elongated opening 64 when frames 12, 14 are in abutting relation, as in FIG. 3. A separate boxlike space 76 is situated proximate the lowest end of the second elongated plunger opening 74 to receive and support a bitter end 78 of the flap 68.

In accordance with the present invention, the first and second cover plates are positioned to envelop a substantial portion of the exterior of the frames and hold the frames in abutting relation. As embodied herein and as shown in FIG. 3, the first cover plate 16 includes a plurality of stanchions 80, preferably three, which project substantially orthogonally from an inner surface 82 of first cover plate 16. The second cover plate 18 includes a plurality of hollow posts 84, which are aligned with the stanchion 80, on an opposite inner surface 86 of second plate 18. Further, slide projections 88, 88' may be positioned to engagement the slide openings 56, 56' and further restrict sliding movement.

As shown in FIG. 3, cover plates 16, 18 include substantially orthogonal end surfaces 90, 90' having first and second mating edges 92, 92'. To facilitate engagement between the mated edges 92, 92', a snap member 94 is positioned on first mating edge 92 for cooperating with a snapping element 96 on second mating edge 92'. Cover plates 16, 18 further include a handle section 98, 98' having substantially orthogonal tabs 100, 100' extending around the perimeter of the handle section 98, 98'. Tabs 100, 100' contain mated surfaces 102, 102'.

Figure 2:
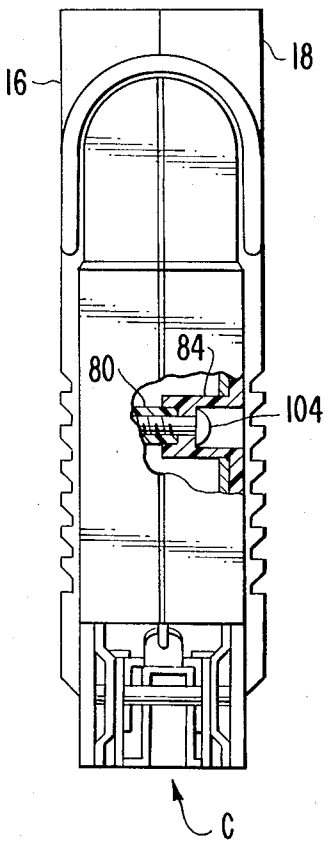
FIG. 2 is a partial cut-away end view of the frame and cover assembly of FIG. 1 viewed in the direction of arrows XX.

In assembling the frame and cover plate assembly of the present invention, which is best seen in FIG. 2, the internal components of stapler A are clamped between frames 12, 14 which form essentially a clam shell housing. The configuration of the abutting frames 12, 14 readily corresponds to certain major stapler components (not shown), and may be viewed as plunger chamber B, magazine section C and stapler body D, as indicated by arrows in FIGS. 1 and 2. The first and second elongated plunger openings 64, 74 are disposed on opposite sides of plunger chamber B and enable sliding engagment with the plunger. A stable support element for the plunger is provided by flap 68 which extends between frames 12 and 14 and engages box-like space 76 with bitter end 78. Staples to plunger chamber B are supplied from the magazine section C that is positioned adjacent base openings 42, 42' and against flanges 44, 44'. Stapler body D is situated atop magazine section C and includes an open section which corresponds to handle openings 46, 46'. Tabs 48, 48', which extend along the upper surface of handle openings 46, 46', provide support for the stapler body D. Thus, the operation of stapler A is integrally related to the cooperation between the stapler component support sections 24, 36 and the internal stapler components, when frames 12, 14 are placed in abutting relation.

After positioning the internal components of the stapler between the frames 12, 14, the cover plates 16, 18 are aligned to form a clam shell configuration about a substantial portion of the exterior of frames 12, 14. The stanchions 80 and hollow posts 84 are inserted in and through sleeve openings 50-54' a sufficient distance to seat the stanchions 80 within the hollow posts 84, as shown in FIG. 2. As embodied herein, means are provided for securing the first and second cover plates 16, 18 together to hold the frames 12, 14 in abutting relation. As shown in FIG. 2, the securing means may include a screw 104, which is to be inserted within each mated stanchion 80 and hollow post 84. Mated edges 92, 92', mated surfaces 102, 102' and snap element 94 cooperate to adhere cover plates 16, 18 to one another, thereby restricting sliding movement between cover plates 16, 18. Further, slide openings 56, 56' receive complementary slide projections 88, 88', as shown in FIG. 3.

In accordance with the present invention, a method of forming a frame and cover assemby for a mechanical stapler is provided. The method involves stamping frame 12 from material such as sheet metal and including a plurality of openings, such as handle opening 46 and first elongated opening 64, and various one-piece extensions, such as flanges 44 and flap 68. Frame 14 is stamped from similar material to include similar openings and extensions, which enable cooperation with frame 14, frame 12 and the internal stapler components of stapler A. Various additional openings or extensions may be formed on frames 12, 14 by the stamping process, as needed. A plastic clam shell housing is formed into first and second cover plates 16, 18. The cover plates 16, 18 envelop a substantial portion of the exterior of the frames. Thus, the frame and cover assembly of the present invention, which provides internal structural support for the internal stapler components, is easily and economically produced by this method.

It will be apparent to those skilled in the art that modifications and variations can be made in the frame and cover apparatus and method of this invention. The invention, in its broader aspects, therefore, is not limited to the specific details, representative methods and apparatus, and illustrative figures shown and described. Thus, it is intended that all matter contained in the foregoing description or shown in the accompanying drawing shall be interpreted as illustrative and not in a limiting sense.

What is claimed is:

1. A mechanical stapler having a lightweight frame and cover assembly, comprising:

a first stamped metallic frame having a first component support section and opposed end sections projecting substantially orthogonally from said first support section to provide first mating edges;

a second stamped metallic frame having a second component support section and opposed end sections projecting substantially orthogonally from said second support section to provide second mating edges, said second mating edges being disposed to engage said first mating edges when said first and second frames are placed in abutting relation;

said first and second support sections having a plurality of openings, selected ones of said openings having a tab extending therefrom, and predetermined ones of said openings in said first frame being aligned with predetermined ones of said openings in said second frame when said first and second frames are in abutting relation;

engaging means extending along said first and second mating edges for restricting sliding movement between said frames when said first and second frames are in abutting relation, said engaging means including edge projections and edge cut-outs, wherein said edge cut-outs are inserted within said edge projections when said first and second frames are in abutting relation;

a first plastic cover plate configured to receive and hold said first frame;

a second plastic cover plate configured to receive and hold said second frame, said first and second cover plates defining a clam shell housing to clamp said frames together; and means for securing said first and second cover plates together and about first and second frames to hold said first and second frames when said frames are positioned in abutting relation.

2. The frame and cover assembly as defined in claim 1, wherein said edge projections include a hooked projection and said edge cut-outs include a first cut-out shaped to receive said hooked projection.

3. The frame and cover assembly as defined in claim 1, wherein said means for securing said cover plates includes at least one snap member.

4. The frame and cover plate assembly as defined in claim 1, wherein at least one of said cover plates contains at least one slide projection extending inwardly toward said first and second frames, and wherein selected ones of said plurality openings receive each of said at least one slide projection to restrict movement of said cover plates relative to said first and second frames.

5. The frame and cover assembly as defined in claim 1, wherein said means for securing said cover plates includes stanchions and complimentary aligned hollow posts, said stanchions and posts projecting through predetermined ones of said aligned openings in said first and second frames for seating said stanchions within said hollow posts when said frame are in abutting relation and said cover plates are joined to hold said frames.

6. The frame and cover assembly as defined in claim 5, wherein said means for securing said cover plates further includes screw means positioned within said stanchions and said aligned hollow posts.

7. The frame and cover assembly as defined in claim 5, wherein said stapler includes a plunger and said frames include means for guiding said plunger.

8. The frame and cover assembly as defined in claim 5, wherein said first support section includes an integral planar extension extending between said frames to provide support for said plunger.

9. The frame and cover assembly as defined in claim 5, wherein said stapler includes a staple magazine and wherein said first and second support sections include an integral flange disposed to provide an adjacent surface to said magazine.

10. The frame and cover assembly as defined in claim 9, wherein said first and second component support sections further include an integral base opening to receive said staple magazine.

* * * * *